US005778775A

United States Patent [19]

Schäfer

[11] Patent Number: 5,778,775

[45] Date of Patent: Jul. 14, 1998

[54] PRINTING UNIT WITH SHORT INKING SYSTEM IN A ROTARY PRINTING MACHINE FOR DIRECT PRINTING USING A "WATERLESS" PLANOGRAPHIC PRINTING PLATE

[75] Inventor: Karl Robert Schäfer, Rimpar, Germany

[73] Assignee: Koenig & Bauer-Albert Aktiengesellschaft, Wurzburg, Germany

[21] Appl. No.: 765,177

[22] PCT Filed: Jul. 6, 1995

[86] PCT No.: PCT/DE95/00887

§ 371 Date: Jan. 14, 1997

§ 102(e) Date: Jan. 14, 1997

[87] PCT Pub. No.: WO96/02390

PCT Pub. Date: Feb. 1, 1996

[30] Foreign Application Priority Data

Jul. 14, 1994 [DE] Germany ..... 44 24 915.2

[51] Int. Cl.[6] ..... B41F 7/00; B41F 31/06

[52] U.S. Cl. ..... 101/141; 101/350.1; 101/351.5

[58] Field of Search ..... 101/141, 220, 101/450.1, 451, 453, 179, 148, 349, 350, 350.1, 351.5

[56] References Cited

U.S. PATENT DOCUMENTS

| | | | |
|---|---|---|---|
| 3,587,463 | 6/1971 | Granger . | |
| 3,613,578 | 10/1971 | Heurich . | |
| 4,208,963 | 6/1980 | Dahlgren | 101/141 |
| 4,407,196 | 10/1983 | Matalia et al. . | |
| 4,805,530 | 2/1989 | Kobler . | |
| 4,903,599 | 2/1990 | Kubler | 101/450.1 |
| 5,053,311 | 10/1991 | Makino et al. | 430/166 |
| 5,272,971 | 12/1993 | Fredericks | 101/136 |

FOREIGN PATENT DOCUMENTS

| | | |
|---|---|---|
| 0 280 140 | 8/1988 | European Pat. Off. . |
| 41 01 797 | 9/1991 | Germany . |

*Primary Examiner*—J. Reed Fisher
*Attorney, Agent, or Firm*—Jones, Tuller & Cooper, P.C.

[57] ABSTRACT

A printing unit of a rotary printing press utilizes a "waterless" planographic printing plate which is fastened on a printing cylinder. This "waterless" planographic printing plate receives ink from a short inking unit and directly prints a material to be printed. An additional printing cylinder, that is also equipped with a "waterless" planographic printing plate, acts as the counterpressure cylinder.

5 Claims, 4 Drawing Sheets

PRINTING UNIT WITH SHORT INKING SYSTEM IN A ROTARY PRINTING MACHINE FOR DIRECT PRINTING USING A "WATERLESS" PLANOGRAPHIC PRINTING PLATE

FIELD OF THE INVENTION

The invention relates to a printing unit of a rotary printing press with a short inking system for direct printing using a "waterless" planographic printing plate.

DESCRIPTION OF THE PRIOR ART

Printing units of rotary offset printing presses with short inking systems, wherein the ink to be printed on a paper web, is transferred indirectly by means of an offset cylinder—the rubber blanket cylinder—from a conventional, i.e. planographic printing plate provided with dampening agent, to a paper web are generally known.

It is disadvantageous here that changes in the measurements of the paper take place because of the dampening agents transferred to the paper.

SUMMARY OF THE INVENTION

The invention is based on the object of providing a printing unit with an inking system for direct printing by means of a "waterless" planographic printing plate.

In accordance with the present invention, a printing unit of a rotary printing press utilizes a "waterless" planographic printing plate that is secured on a printing cylinder. The printing unit is provided with a short inking unit that includes a structured ink transfer roller and a doctor blade device. This short inking unit cooperates with the "waterless" planographic printing plate. A second printing cylinder, that is equipped with a second "waterless" planographic printing plate is provided and acts as the counterpressure cylinder for the printing unit.

The advantages which can be achieved by means of the present invention reside, in particular, in that paper warping because of dampening agents does not occur. Since no dampening agents are used, an assured ink transfer which remains constant is assured.

The printing cylinder with the soft "waterless" planographic printing plate takes over the function of the otherwise customary rubber blanket cylinder, and provides, for example, an even transfer of the pressure force even with rough paper.

It is particularly advantageous that, because the rubber blanket cylinder is no longer needed, there is only one ink transfer point between the planographic printing plate and the material to be printed, because of which less re-splitting and squeezing out of the printing ink takes place. Because of this, it is possible to transfer thicker printing ink layers, which elsewhere are only achieved in connection with rotogravure or screen printing processes. Besides this, the present printing unit, without a rubber blanket cylinder, is considerably cheaper than comparable offset printing systems.

The use of a short inking system without ink zones for inking this "waterless" planographic printing plate is particularly advantageous, since, in this case, adjustment work for maintaining the ink transfer constant are omitted. In addition, the amount of waste is minimized. The simple construction makes maintenance work easier and the investment costs are extremely low.

BRIEF DESCRIPTION OF THE DRAWINGS

Preferred embodiments of the present invention are represented in the drawings and will be described in more detail below.

Shown are in.

DETAILED DESCRIPTION OF THE PREFERRED EMBODIMENTS

Figure 1:
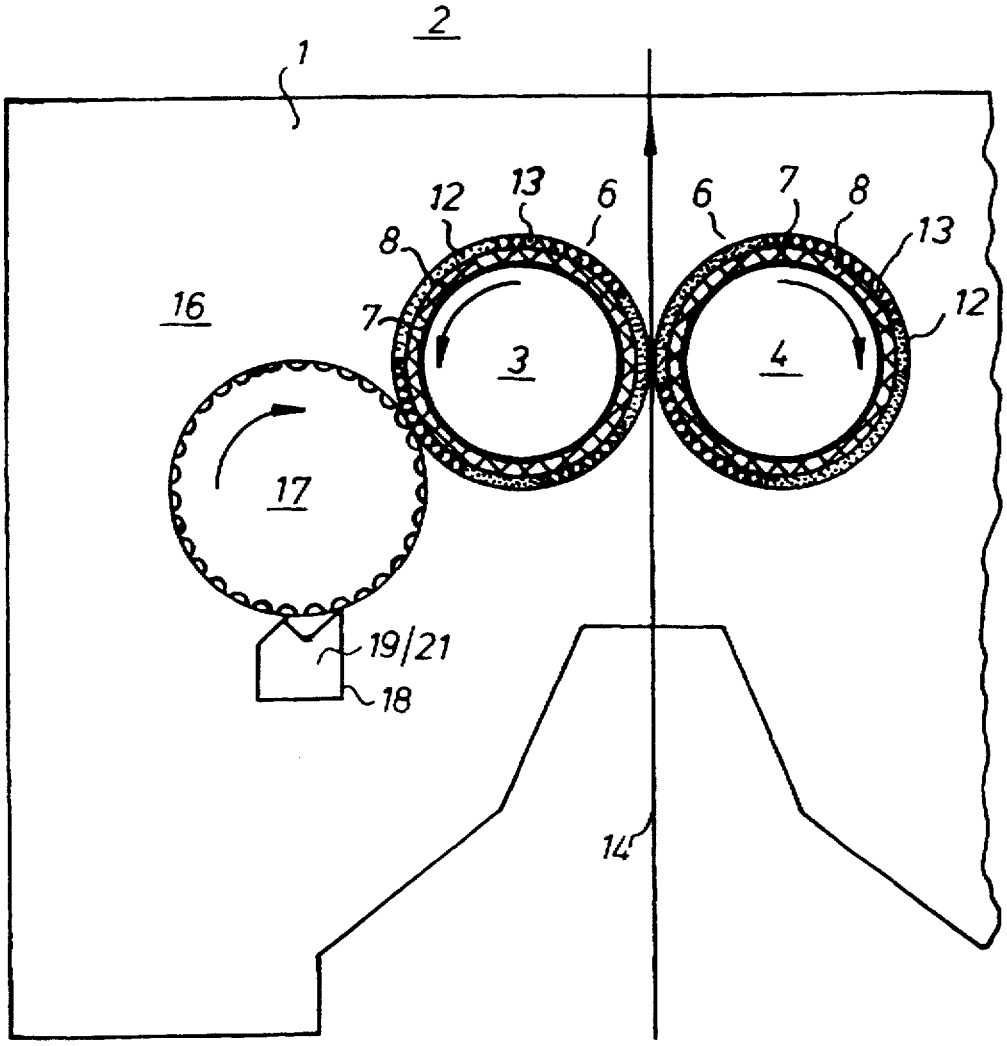
FIG. 1, a schematic representation of a first preferred embodiment of a printing unit in accordance with the present invention with a short inking system.

A printing unit 2, in accordance with a first preferred embodiment of the present invention, and consisting of two printing cylinders 3, 4, wherein the second printing cylinder 4 acts as a counter-pressure cylinder for the first printing cylinder 3, is seated in lateral frames 1 of a rotary printing press. This printing unit 2 is shown in FIG.1.

Figure 2:
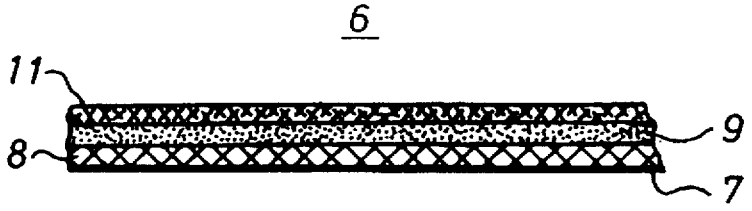
FIG. 2, a schematic section through a planographic printing plate.

One "waterless" planographic printing plate 6 for direct printing is fastened on each of the printing cylinders 3, 4 shown in FIG. 1. This planographic printing plate 6 has a metal or plastic support 7, a rubber layer 8 applied to this metal support 7, a photosensitive resin layer 9 applied to this rubber layer 8 and a silicon caoutchouc layer 11 applied to this photosensitive resin layer 8 all as may be seen in FIG. 2. The planographic printing plate 6 is changed by means of known processes in such a way, that the photosensitive resin layer 9 forms ink-accepting, printing areas 12, and the silicon caoutchouc layer 11 forms ink-rejecting, non-printing areas 13. The soft rubber layer 8 corresponds to an offset print rubber blanket. A material 14 to be printed, for example a paper web, is directly printed between the printing cylinders 3 and 4 from the respective "waterless" planographic printing plate 6 supplied with ink, as seen in FIG. 1.

A short inking system 16, which is composed of a structured ink transfer roller 17, and a doctor blade device 18, cooperates with this first planographic printing plate 6 carried on the first printing cylinder 3, and provides the planographic printing and plate 6 with printing ink 19. A printing ink 19 which is suitable for "waterless" planographic printing, which is mixed with a parting agent 21, for example silicon oil or resins modified by silicon, is used as printing ink 19.

The ink transfer roller 17 consists of a steel core 22, which can have bearing journals. On its circumference, this steel core 22 is provided with a coating 23 of a wear-resistant material, for example of a hard ceramic material, which is applied by means of a spray method, for example. This coating 23 is structured, in that depressions 24, for example small cups or grooves, are engraved, for example by a laser process. Lands 26 which, for example, can intersect or extend approximately parallel with each other, result between these depressions 24. These lands 26 consist of wear-resistant, hard ceramic material and have a high affinity to the part for which reason silicon oxide, aluminum oxide or chromium oxide, for example, which have been soaked in silicon oil or into which silicon rubber or fluorosilicon rubber has been embedded, are used as the hard ceramic material.

Figure 3:
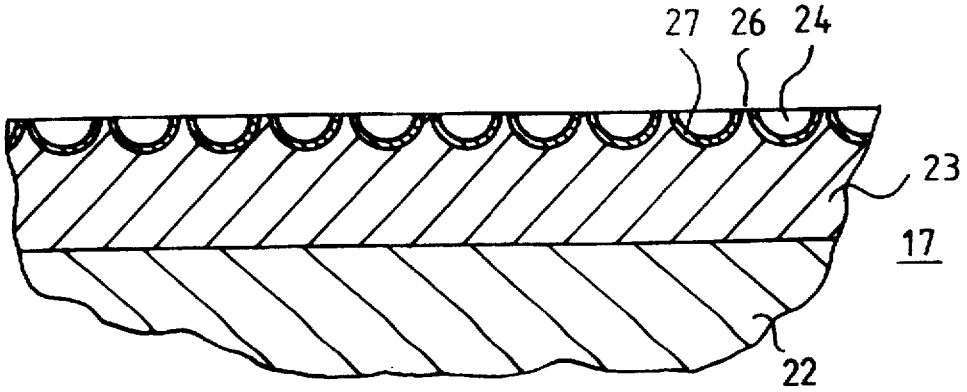
FIG. 3, a portion of a schematic section of a structured ink transfer roller.

The depressions 24 are lined with an ink-friendly coating 27, for example a quinone diazid polymer substance all as depicted in FIG. 3.

The printing ink 19, mixed with parting agent 21, is supplied to the structured ink transfer roller 17 by means of the doctor blade device 18. This ink transfer roller 17 transfers the printing ink 19 directly to the planographic printing plate 6, which inks printing areas 12 of the planographic printing plate 6 with printing ink 19, while the parting agent portion of the printing ink 19 is passed on to non-printing areas 13 of the planographic printing plate 6.

Figure 4:
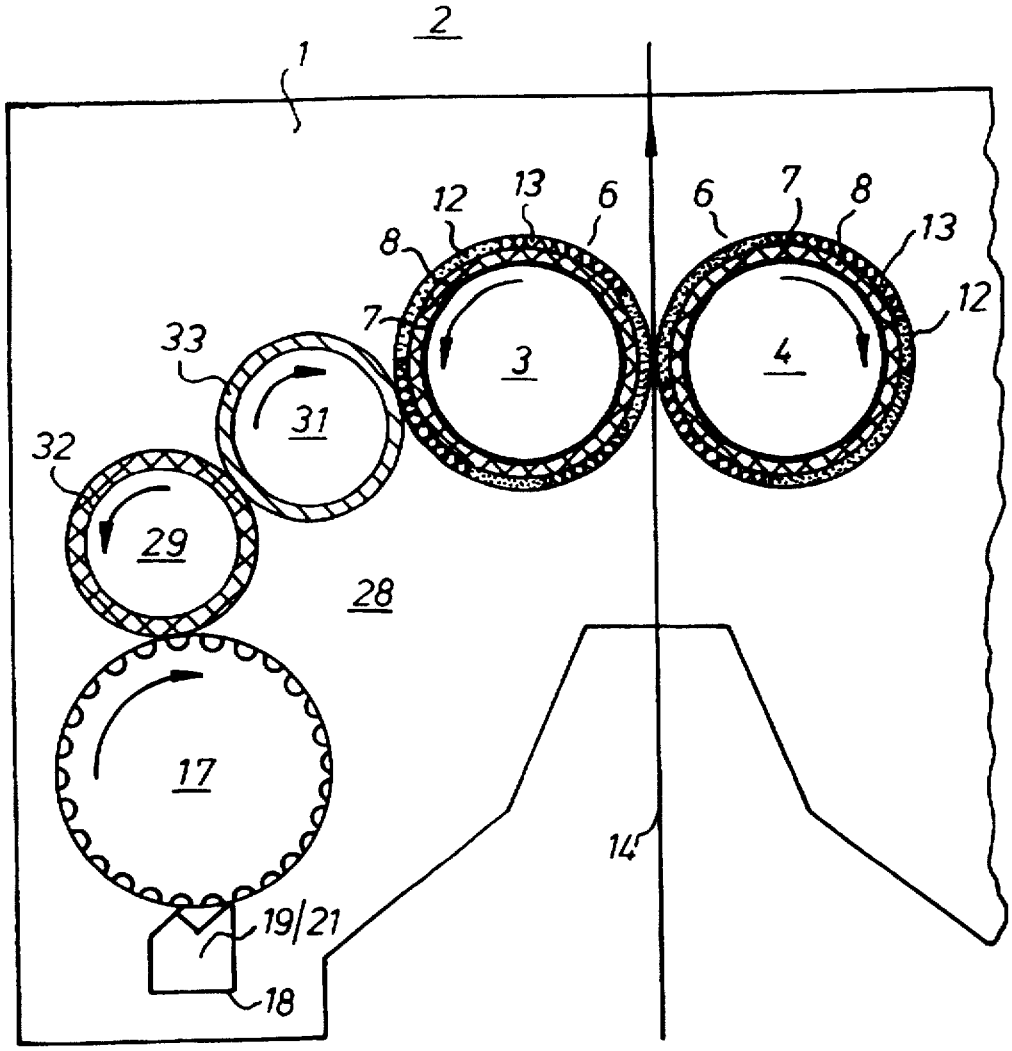
FIG. 4, a schematic representation of a second preferred embodiment of a printing unit in accordance with the invention with a short inking system.

It is, of course, possible to dispose any arbitrary number of ink transfer rollers between the first printing cylinder 3 and the structured ink transfer roller 17. For example, with a short inking system 28 and two further ink transfer rollers 29, 31 can be situated between the first printing cylinder 3 and the structured ink transfer roller 17 and can transfer printing ink 19. In this second preferred embodiment, ink transfer roller 29 resting against the structured ink first transfer roller 17 is provided with a soft coating, while the second ink transfer roller 31, which engages both the first planographic printing plate 6 and the ink transfer roller 29 has a hard coating 33 as may be seen by referring to FIG. 4.

Figure 5:
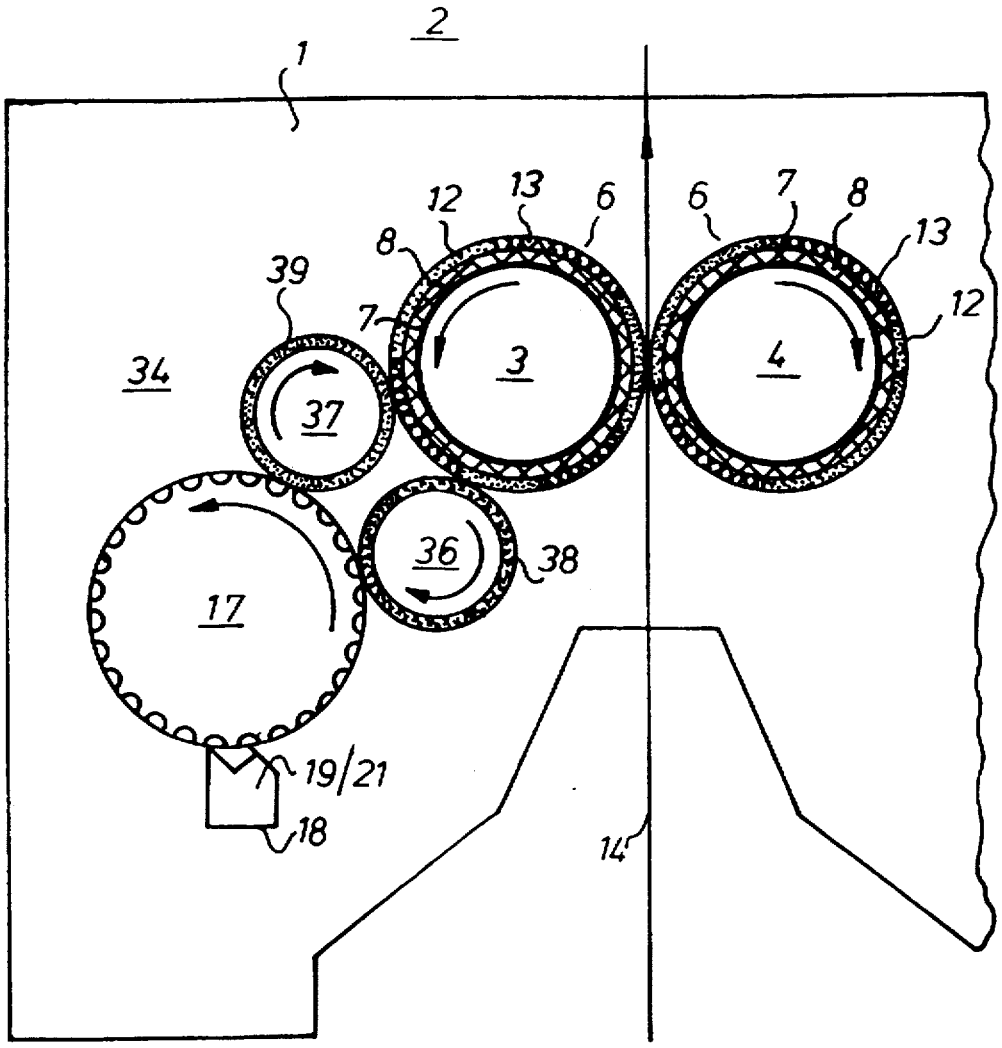
FIG. 5, a schematic representation of a third preferred embodiment of a printing unit in accordance with the invention with a short inking system.

In the third preferred embodiment of a short inking system 34 as shown in FIG. 5, two ink transfer rollers 36, 37 are disposed, and both touch the "waterless" planographic printing plate 6 and also the structured ink transfer roller 17. The first ink transfer roller 36 has a soft, ink-friendly coating 38, and the second ink transfer roller 37 has a soft, parting agent-friendly coating 39, for example silicon rubber or fluorosilicon rubber.

While preferred embodiments of a printing unit with a short inking unit in a rotary printing machine for direct printing using a "waterless" planographic printing plate in accordance with the present invention have been set forth fully and completely hereinabove, it will be apparent to one of skill in the art that a number of changes in, for example, the size of the printing press, the drive arrangement for the printing cylinders, the type of web being printed and the like could be made without departing from the true spirit and scope of the present invention which is accordingly to be limited to the following claims.

What is claimed is:

1. A printing unit of a rotary printing press comprising:

a first printing cylinder;

a first, soft waterless planographic printing plate secured to said first printing cylinder for directly printing a material to be printed, said first, soft waterless planographic printing plate having waterless ink accepting printing areas and waterless ink rejecting areas, said waterless ink rejecting areas being accepting of a waterless ink parting agent;

a short inking unit including at least one structured ink transfer roller and a doctor blade device, said short inking unit cooperating with said first waterless planographic printing plate, said structured ink transfer roller having a plurality of depressions separated by a plurality of lands, said depressions being waterless ink accepting, said lands being waterless ink parting agent accepting, said doctor blade device supplying waterless printing ink to said structured ink transfer roller;

a second printing cylinder; and a second, soft waterless planographic printing plate secured to said second cylinder and forming a counterpressure cylinder for said first waterless planographic printing plate whereby a web is printed by passage between, and contact with said first printing cylinder and said second printing cylinder.

2. The printing unit of claim 1 wherein said short inking unit further includes first and second ink transfer rollers both of which contact said structured ink transfer roller and said first waterless planographic printing plate.

3. The printing unit of claim 2 wherein one of said first and second ink transfer rollers is provided with a soft, parting agent-accepting coating.

4. The printing unit of claim 2 wherein one of said first and second ink transfer rollers is provided with a soft ink-accepting coating.

5. The printing unit of claim 1 further including a plurality of ink transfer rollers positioned between said structured ink transfer roller and said first waterless planographic printing plate.

* * * * *